US006047444A

United States Patent [19]

Braun

[11] Patent Number: 6,047,444

[45] Date of Patent: Apr. 11, 2000

[54] POSITIVE LOCK ARMREST MECHANISM

[75] Inventor: Eric W. Braun, Novi, Mich.

[73] Assignee: Fisher Dynamics Corporation, St. Clair Shores, Mich.

[21] Appl. No.: 09/151,753

[22] Filed: Sep. 14, 1998

[51] Int. Cl.[7] ..... E05D 11/10

[52] U.S. Cl. ..... 16/324; 16/325; 16/334; 16/357; 297/411.32; 297/411.38; 297/113

[58] Field of Search ..... 16/324, 325, 326, 16/334, 344, 357, 358, 359; 297/411.3, 411.32, 411.35, 411.38, 117, 113, 378.12, 378.14

[56] References Cited

U.S. PATENT DOCUMENTS

| | | | |
|---|---|---|---|
| 3,866,270 | 2/1975 | Suzuki et al. | 16/324 |
| 3,999,247 | 12/1976 | Cremer | 16/324 |
| 4,148,525 | 4/1979 | Yamanashi | 16/324 |
| 4,355,846 | 10/1982 | Kluting et al. | 16/324 |
| 5,058,240 | 10/1991 | Barda et al. | 16/325 |
| 5,460,429 | 10/1995 | Whalen . | |
| 5,476,307 | 12/1995 | Whalen . | |
| 5,507,561 | 4/1996 | Fourrey et al. | 297/378.12 |
| 5,681,079 | 10/1997 | Robinson . | |
| 5,718,481 | 2/1998 | Robinson . | |
| 5,749,625 | 5/1998 | Robinson . | |

*Primary Examiner*—Chuck Y. Mah
*Attorney, Agent, or Firm*—Harness, Dickey & Pierce P.L.C.

[57] ABSTRACT

A hinge mechanism including a positive latching assembly is provided for allowing rotation of a first hinge member relative to a second hinge member about a pivot when the positive latch is released and prevents rotation about the pivot when the positive latch is engaged. The positive latching assembly is operably disposed between the first and second hinge members. The latching assembly includes a locking member coupled to the second hinge member and a pivotable latching member coupled to the first hinge member. The latching member is rotatable between a locking position and a release position and includes a locking surface for engaging the locking member in the locking position. Further, the locking surface disengages the locking member when the latching member is in the release position.

18 Claims, 5 Drawing Sheets

POSITIVE LOCK ARMREST MECHANISM

BACKGROUND OF THE INVENTION

1. Technical Field

This invention relates generally to a hinge for a folding armrest or passenger seat of the type used in passenger vehicles and, more particularly, to a hinge mechanism having a positive latch assembly which permits the armrest or passenger seat to be folded forward during normal use but which locks in an upright position to prevent folding prior to the manual release of a positive latch.

2. Discussion

As is known, passenger vehicles commonly include one or more armrests located between adjacent seats such as, for example, between driver and passenger portions of a bench seat. The seat occupants can move the armrest between a stowed position in which the armrest is concealed within or abuts the seatback and a deployed position in which the armrest is folded out to rest against the seat bottom. Alternatively, passenger vehicles commonly include a center passenger seat located between the driver and passenger seats. The center passenger seat can similarly be moved between a stowed position and a deployed position.

Typically, the armrest or center passenger seat includes a pair of hinges supporting opposite sides thereof for pivotable movement between the stowed and deployed positions. Each hinge includes upper and lower hinge members with the upper hinge member rotating with respect to the lower hinge member about a pivot. More particularly, the upper hinge member is typically connected to an upholstered armrest cushion or seat cushion while the lower hinge member is connected to the frame structure of the vehicle seat or vehicle floor.

While conventional armrests are provided to enhance the comfort of the seat occupants and conventional folding center passenger seats provide additional passenger seating, they can unexpectedly move from the stowed position toward the deployed position during a sudden vehicular deceleration condition, for example caused by a frontal collision or heaving braking of the motor vehicle. If a seat occupant is sitting in between the driver and passenger seats, such a deceleration can cause the armrest or folding center passenger seat to strike the passenger which may cause injury. Additionally, unexpected movement of the armrest or folding center passenger seat from the stowed position toward the deployed position can occur more frequently as the hinges wear and become loose.

One approach for addressing this condition is the use of an inertia-sensitive hinge mechanism which allows rotation of a first hinge member relative to a second hinge member about a pivot during normal use and prevents rotation about the pivot when predetermined deceleration forces are present. While inertia-sensitive latching assemblies have achieved great success, it has now become desirable to provide a hinge for use in folding armrests or center passenger seats including a positive latch assembly which inhibits movement from a stowed position to a deployed position prior to the manual release of the positive latch assembly.

SUMMARY OF THE INVENTION

Accordingly, the present invention is directed to providing an improved hinge mechanism of the type having a positive latching assembly.

The positive latching hinge mechanism allows rotation of a first hinge member relative to a second hinge member about a pivot when the positive latch is released and prevents rotation about the pivot when the positive latch is engaged. The positive latching assembly includes a latching assembly operably disposed between the first and second hinge members. The latching assembly includes a locking member coupled to the second hinge member and a pivotable latching member coupled to the first hinge member. The latching member is rotatable between a locking position and a release position and includes a locking surface for engaging the locking member in the locking position. The locking surface is spaced apart from the locking member when the latching member is in the release position. According to this configuration, the hinge mechanism has zero chuck when the latching member engages the locking member.

In another feature of the present invention, an actuator is provided for selectively engaging the latching member to maintain the latching member in the locking position. The actuator is also selectively moveable out of engagement with the latching member for permitting the latching member to move to the release position.

In yet another feature of the invention, a biasing member is provided for urging the actuator into engagement with the latching member such that the actuator automatically engages the latching member when the second hinge member is moved to an upright position.

In still another feature of the invention, a biasing member is provided for urging the latching member toward the release position such that the latching member automatically disengages the locking member when the actuator is moved out of engagement with the latching member thereby permitting the second hinge member to be rotated from the upright position to a folded position.

In an additional feature of the invention, an orientation member is coupled to the first hinge member and includes at least two positioning surfaces for cooperating with positioning members coupled to the second hinge member for positioning the second hinge member in preselected orientations relative to the first hinge member.

In a further feature of the invention, a pull tab is coupled to the actuator to enable an operator to move the actuator into and out of engagement with the latching member.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards a positive locking hinge mechanism for an armrest or seatback in a motor vehicle. The hinge mechanism of the present invention enables the armrest/seatback to be freely moved between a folded or deployed position substantially adjacent a seat bottom and an upright or stowed position substantially vertically aligned with the seat back. The hinge mechanism includes a latching assembly for locking the armrest in the upright position such that it has zero chuck. Further, the latching assembly prevents the armrest/seatback from rotating prior to the manual release of the latching assembly.

Figure 1:
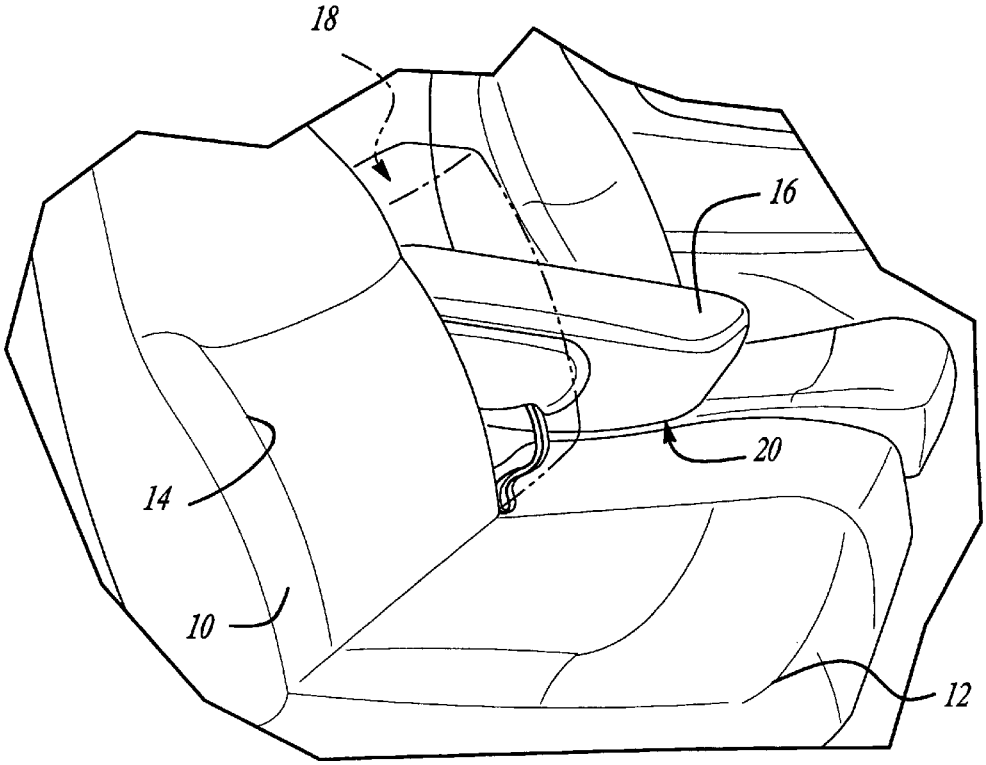
FIG. 1 is a perspective view of a vehicle seat having a fold down armrest member including the positive locking hinge mechanism of the present invention incorporated therein.

Referring now to the drawing figures, FIG. 1 illustrates a typical environment wherein the hinge mechanism of the present invention may be employed. More particularly, a vehicle seat 10 includes a seat bottom 12 and a rearwardly angled seatback 14. The seatback 14 includes an armrest member 16 rotatably positionable between an upright position, generally indicated at 18, aligned with the seatback 14 and a folded position, generally indicated at 20, adjacent the seat bottom 12. While the remainder of this description refers to the hinge mechanism in conjunction with an armrest, one skilled in the art will appreciate that the hinge mechanism could also be used with a folding seatback or other similar component.

Figure 2:
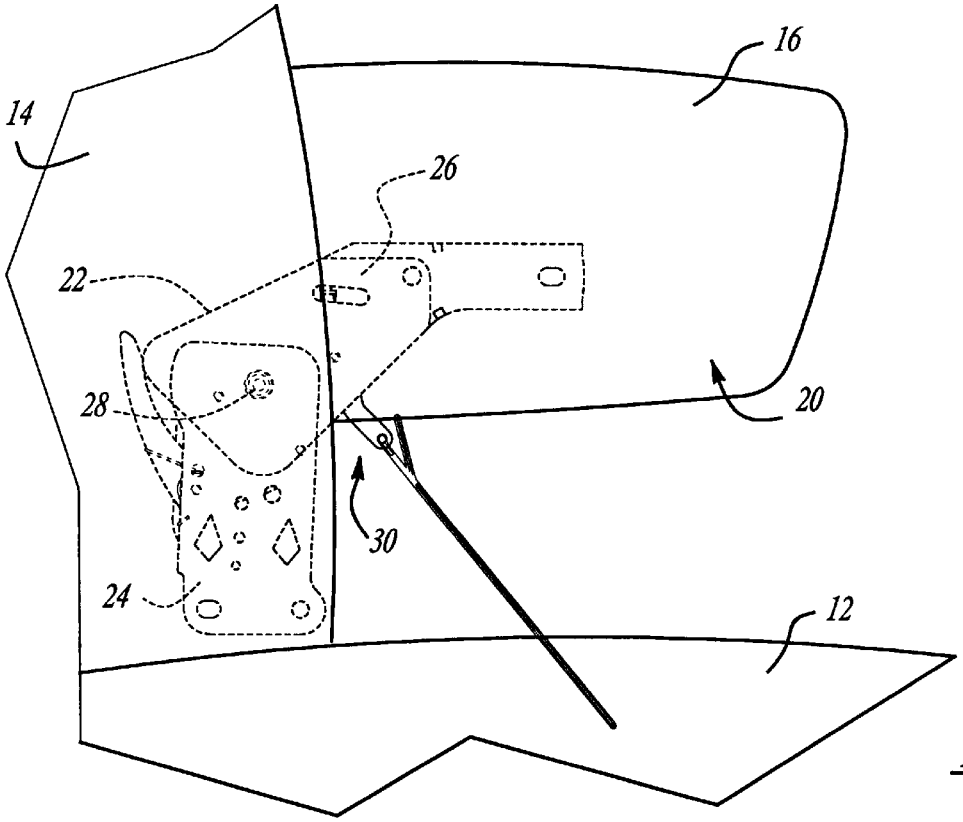
FIG. 2 is a side view of the armrest member of FIG. 1 illustrating the hinge mechanism of the present invention in phantom.

Referring now to FIG. 2, the positive locking hinge mechanism 22 of the present invention is illustrated in phantom within the armrest 16 and seatback 14. The hinge mechanism 22 includes a first hinge member 24 pivotally coupled to a second hinge member 26 about a first pivot 28. The first hinge member 24 is fixed to the inner structure (not shown) of the seatback 14 in a conventional manner. Similarly, the second hinge member 26 is fixed to the inner support structure of the armrest 16 in a conventional manner. As such, the second hinge member 26 may be rotated about the first pivot 28 relative to the first hinge member 24 by rotation of the armrest 16 relative to the seatback 14. As will be described in greater detail below, rotation of the second hinge member 26 from the upright position 18 (FIG. 1) to the folded position 20 is prevented prior to the manual release of a latch assembly generally indicated at 30.

Figure 3:
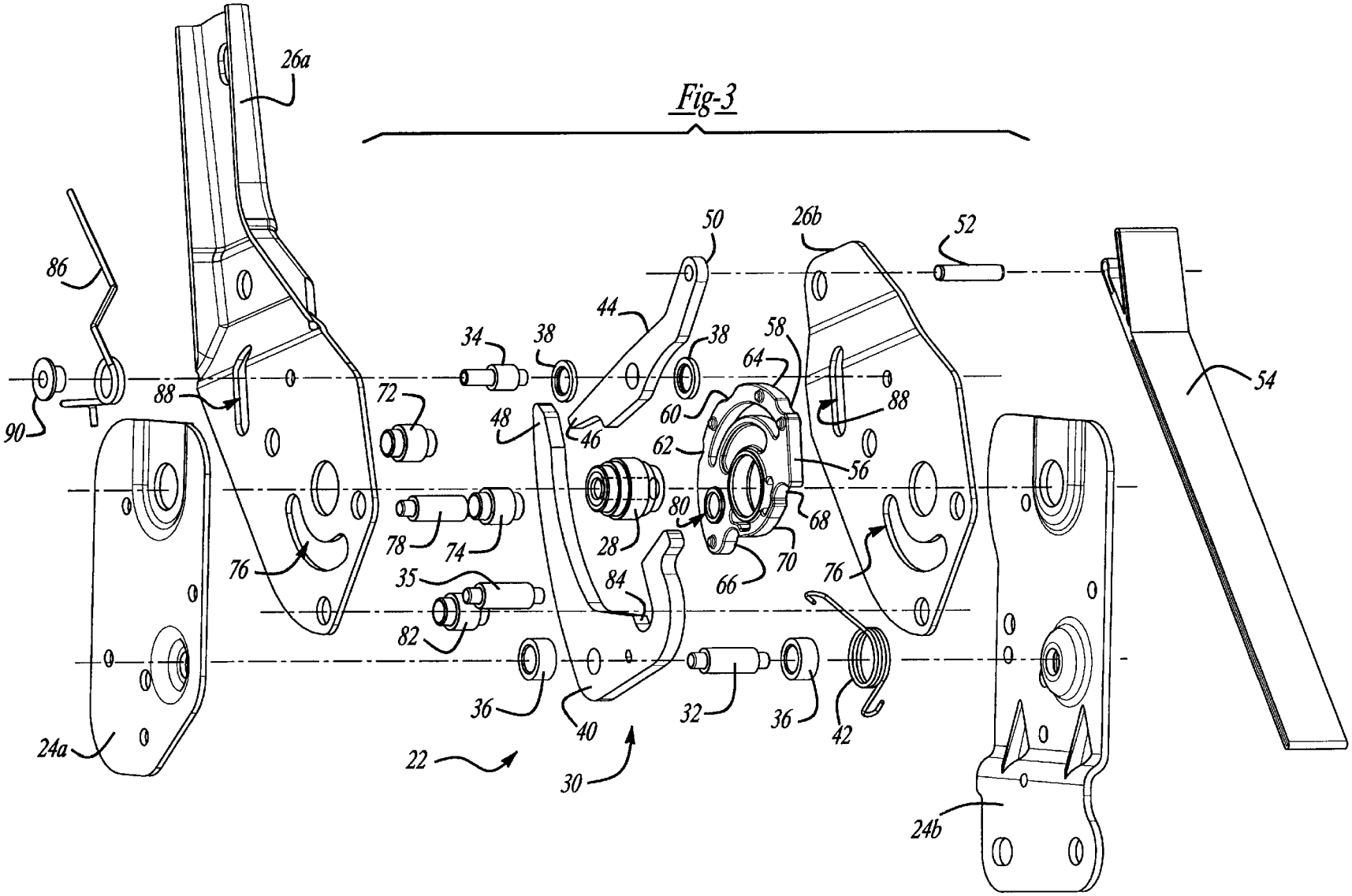
FIG. 3 is an exploded view of the hinge mechanism according to the present invention.
Figure 9:
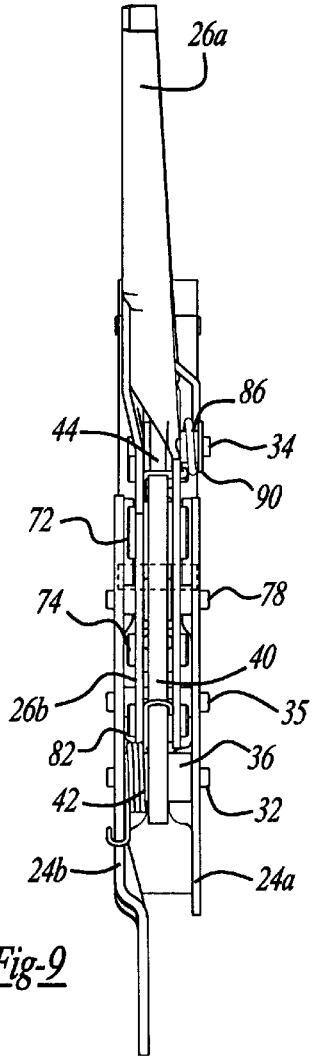
FIG. 9 is a front view of the hinge mechanism of the present invention.

Turning now to FIGS. 3 and 9, the positive locking hinge mechanism 22 including the latch assembly 30 will be described in greater detail. First hinge member 24 includes two laterally spaced apart plates 24A and 24B for accommodating latching assembly 30 therebetween. Similarly, second hinge member 26 includes two laterally spaced plates 26A and 26B disposed interior of first hinge member plates 24A and 24B and being spaced apart to accommodate latching assembly 30. First and second hinge members 24 and 26 may be fabricated by matingly attaching the flanged plates as illustrated using rivets, welding, or other conventional techniques. For example, first hinge member 24 includes rivet 32 for interconnecting plates 24A and 24B. Similarly, second hinge member 26 includes rivet 34 for interconnecting plates 26A and 26B. Further, a rivet 35 interconnects plates 24A and 24B as well as plates 26A and 26B. As will be appreciated, various spacers, such as spacers, washers, etc., 36 and 38, may be included between the plates of the first and second hinge members 24 and 26 to appropriately accommodate the latching assembly 30 therebetween.

The latching assembly 30 includes a generally L-shaped latching member or arm 40 pivotally coupled at a mid-section about rivet 32 (also referred to hereinafter as the second pivot 32) to the first hinge member 24. A first biasing member in the form of a coil spring 42 interengages the latching arm 40 and the first hinge member 24 to urge the latching arm 40 in a preselected direction.

The latching assembly 30 also includes an actuator 44 pivotally coupled at a mid-section to the second hinge member 26 about the rivet 34 (also referred to hereinafter as the third pivot 34). The actuator 44 includes a first end 46 for selectively engaging an end 48 of the latching arm 40. A second end 50 of the actuator 44 extends beyond the periphery of the second hinge member 26 (see FIG. 2) and is coupled by a pin 52 to an end of a pull tab or strap 54.

An orientation member in the form of a C-shaped cam disk 56 is fixed between the plates 26A and 26B of the second hinge member 26 about pivot 28. The cam disk 56 includes a plurality of positioning surfaces for positioning the second hinge member 26 relative to the first hinge member 24. More particularly, the cam disk 56 includes a folded positioning detente surface 58, a neutral positioning detente surface 60, and an upright positioning detente surface 62 radially spaced apart along an outer peripheral surface 64. The cam disk 56 also includes a complementary folded positioning detente surface 66 and a complementary upright positioning detente surface 68 radially spaced apart along an inner peripheral surface 70.

A first positioning member or pin 72 is laterally coupled to the second hinge member 26 for cooperating with the folded positioning detente surface 58, the neutral positioning detente surface 60, and the upright positioning detente surface 62 as the second hinge member 26 is rotated relative to the first hinge member 24. A second positioning member or pin 74 is also laterally coupled to the second hinge member 26 for moving in concert with the first positioning pin 72 so as to engage the complementary folded positioning detente surface 66 and the complementary upright positioning detente surface 68.

The second hinge member 26 also includes a partially circumferentially extending guide slot 76 for receiving a guide pin 78 coupled to the first hinge member 24 and passing through the cam disk 56 at orifice 80. A locking member or pin 82 is laterally coupled to the second hinge member 26 and is operable for selectively engaging a U-shaped locking surface 84 formed in the latching arm 40. A second biasing member in the form of a second coil spring 86 interengages the second hinge member 26 and the actuator 44 through slot 88 for urging the actuator 44 in a preselected direction. The coil spring 86 is preferably coupled to the plate 26A by cap 90.

Figure 4:
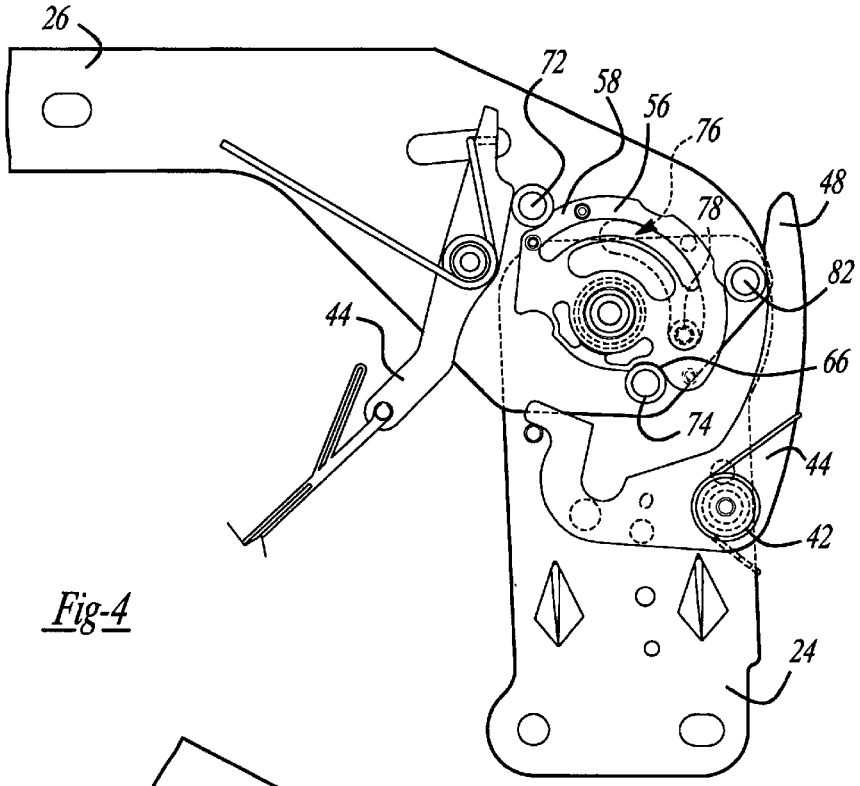
FIG. 4 is a side view of the hinge mechanism of the present invention having the side plate removed for clearer illustration and depicted in a folded position.

Referring now to FIGS. 4–8, the operation of the present invention will be described. In FIG. 4, the hinge mechanism 22 is illustrated with the second hinge member 26 in its folded position 20 generally orthogonal to the first hinge member 24. The second hinge member 26 is held in this position by the partial circumferential engagement of the first positioning pin 72 with folded positioning detente surface 58 of the cam disk 56. This position is also maintained by the partial circumferential engagement of the second positioning pin 74 with the complementary folded positioning detente surface 66 of the cam disk 56. It should also be noted that in this position the actuator 44 is spaced apart from the latching arm 44 which is abutting the locking pin 82 at end 48.

As compared to its locking position described below, in this orientation, the latching arm 40 is said to be spaced apart from the second hinge member 26. The latching arm 40 is biased against the locking pin 82 and towards its release position, also described in greater detail below, by the coil spring 42. Further, the guide pin 78 is located at a first end of the guide slot 76.

Figure 5:
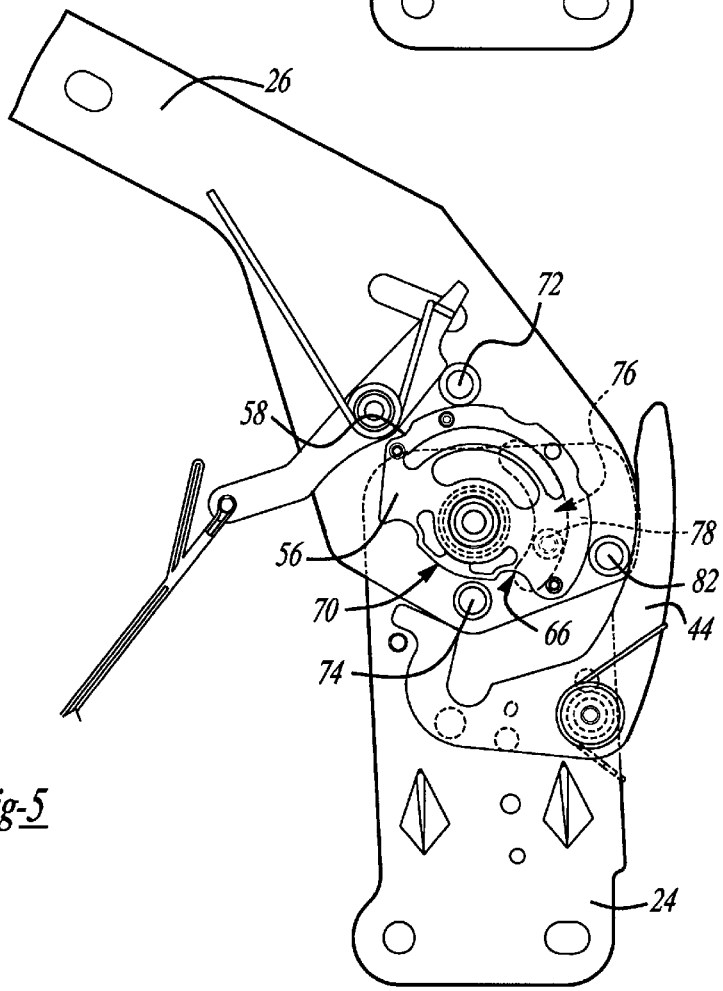
FIG. 5 is a side view of the hinge mechanism in a transition position between the folded position and a neutral position.

Referring now to FIG. 5, the second hinge member 26 has been rotated slightly with respect to the first hinge member 24 so as to be located in a transition position between the folded position illustrated in FIG. 4 and a neutral position to be described with reference to FIG. 6. In this transition position, the first positioning pin 72 disengages from the folded positioning detente surface 58 and rides along the outer surface 64 of the C-shaped cam disk 56. Likewise, the second positioning pin 74 disengages from the complementary folded positioning detente surface 66 and rides along the inner surface 70 of the C-shaped cam disk 56. Further, the guide slot 76 has moved along the guide pin 78 and the locking pin 82 has moved slightly with respect to the latching arm 44 towards the locking surface 84.

Figure 6:
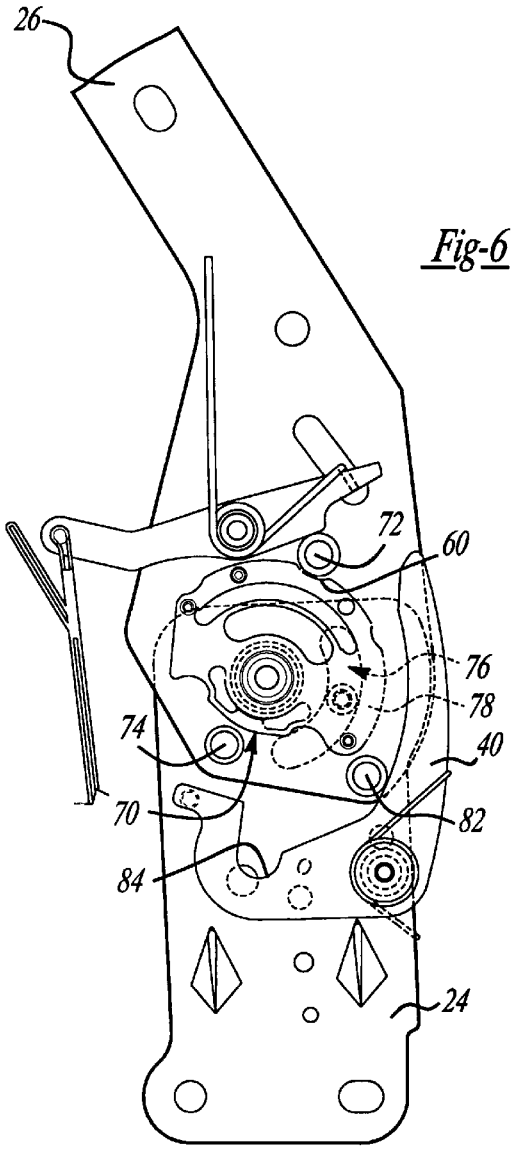
FIG. 6 is a side view illustrating the hinge mechanism of the present invention in a neutral position.

Referring now to FIG. 6, the second hinge member 26 has been rotated from the transition position of FIG. 5 to the neutral position essentially vertically aligned relative the first hinge member 24. Although this position is useful to end users, it is primarily an assembly position. In this position, the first positioning pin 72 secures the second hinge member 26 relative the first hinge member 24 by partially circumferentially engaging the neutral positioning detente surface 60. The guide slot 76 has also rotated relative to guide pin 78. Further, the second positioning pin 74 has been rotated further along the inner surface 70 of the cam disk 56 toward, but not yet engaging, the complementary upright positioning detente surface 68. Additionally, the locking pin 82 is now rotated under the cam disk 56 towards, but not yet engaging, the locking surface 84 of the latching arm 40. The second hinge member 26 may be rotated from this neutral position relative to the first hinge member 24 by simply overcoming the frictional engagement of the first positioning pin 72 with the neutral positioning detente surface 60.

Figure 7:
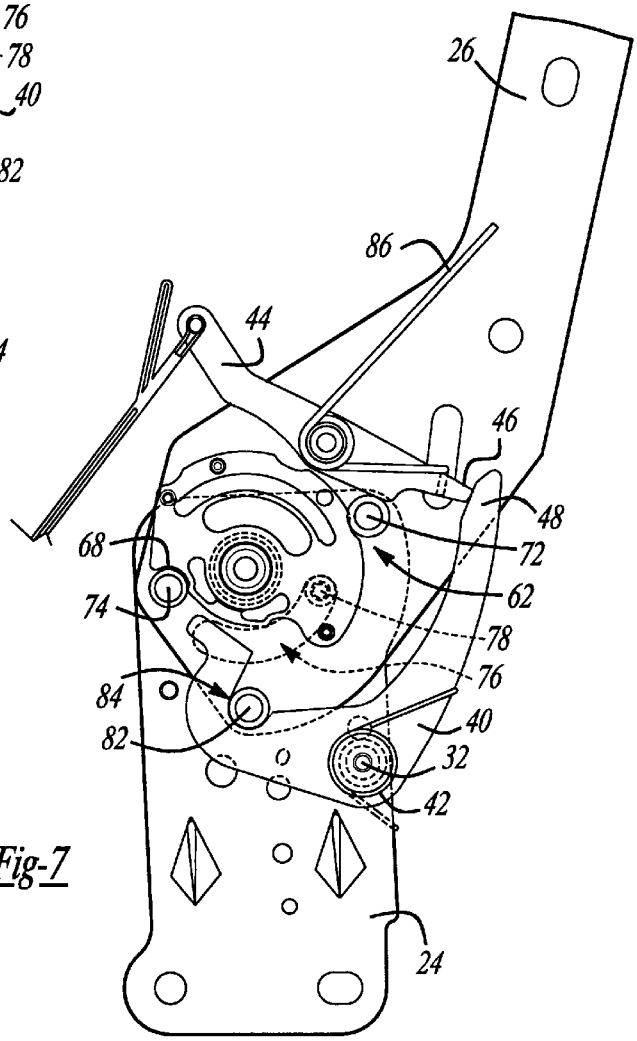
FIG. 7 is a side view of the hinge mechanism of the present invention in the upright position.

Referring now to FIG. 7, the second hinge mechanism 22 has been rotated to its upright position relative to the first hinge member 24. This position is "over-center" with respect to the vertical axis of the first hinge member 24 so that the armrest 16 is essentially co-planer with the seatback 14 (see FIG. 1). In this position, the first positioning pin 72 partially circumferentially engages the upright positioning detente surface 62 while the second positioning pin 74 circumferentially engages the complementary upright positioning detente surface 68. Further, the guide pin 78 is positioned at the opposite end of the guide slot 76.

Also, the locking pin 82 is nested within the locking surface 84 of the latching arm 40. In accordance with the teachings of the present invention, the second hinge member 26 is now locked in this upright position relative to the first hinge member 24 such that the second hinge member 26 is prevented from rotation relative to the first hinge member 24 prior to release of the latching arm 40 with the locking pin 82. This occurs by way of the engagement of the first end 46 of the actuator 44 with the end 48 of the latching arm 40. That is, as the second hinge member 26 is rotated towards its upright position, the first end 46 of the actuator 44 engages the end 48 of the latching arm 40 and rotates the latching arm 40 against the bias of the coil spring 42 about the second pivot 32. As such, the locking surface 84 circumferentially engages the locking pin 82. Thereafter, further rotation of the second hinge member 26 relative to the first hinge member 24 is prevented. More particularly, forward rotation of the second hinge member 26 drives the locking pin 82 into the locking surface 84. Disengagement is prevented by the location of the second pivot 32 relative to the locking pin 82 and the engagement of the end 48 of the latching arm 40 with the first end 46 of the actuator 44. It should be noted that the second coil spring 86 also helps maintain the locked condition by biasing or urging the actuator 44 into engagement with the latching arm 40.

Figure 8:
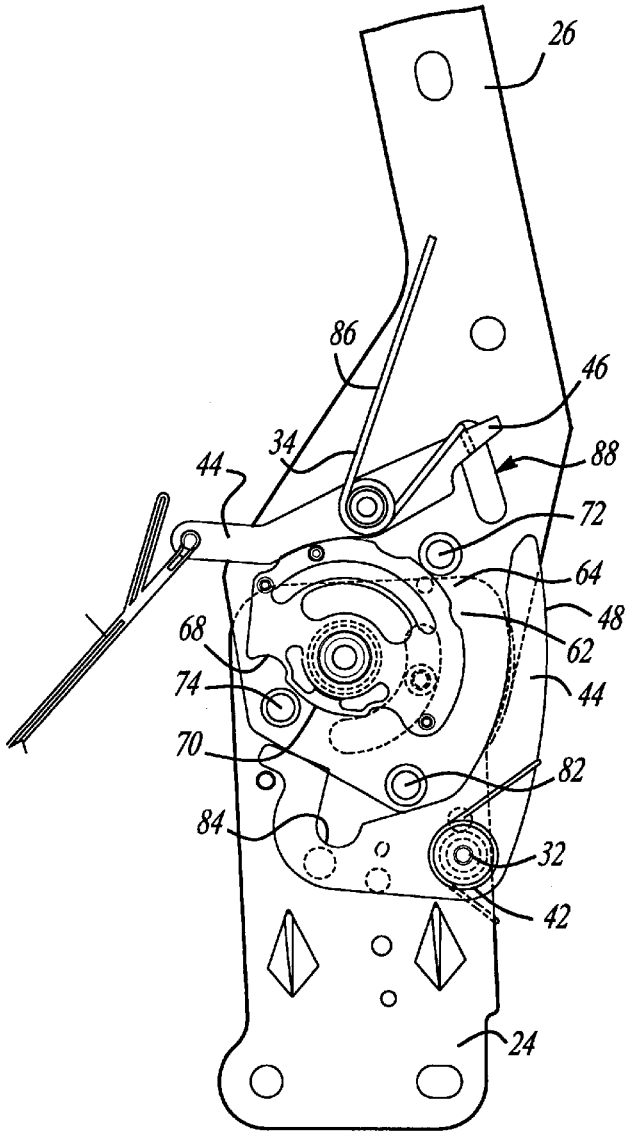
FIG. 8 is a side view of the hinge mechanism of the present invention in a transition position between the upright position and the neutral position.

Referring now to FIG. 8, the second hinge member 26 has been rotated from its upright position as illustrated in FIG. 7 to a transition position between the upright position and the neutral position illustrated in FIG. 6. In order to achieve this transition position, the actuator 44 is rotated to its disconnecting position toward a far end of slot 88 by a user pulling on the pull tab or strap 54 and rotating the actuator 44 about the third pivot 34 against the bias of the coil spring 86. In its disconnecting position, the actuator 44 is spaced apart from (i.e., disengages) the latching arm 40. As such, the coil spring 42 rotates the latching arm 40 about the second pivot 32 towards its release position where the locking surface 84 separates from the locking pin 82. When the locking surface 84 clears the locking pin 82 the second hinge member 26 may be rotated relative to the first hinge member 24.

Upon rotation, the first positioning pin 72 disengages from the upright positioning detente surface 62 and rides along the outer surface 64 of the cam disk 56. Likewise, the second positioning pin 74 disengages from the complementary upright positioning detente surface 68 and rides along the inner surface 70 of the cam disk 56. Thereafter, the actuator 44 may be released and the second hinge member 26 may freely rotate relative the first hinge member 24.

Thus, in accordance with the present invention, a second hinge member is readily movable between a folded position and an upright position by overcoming the frictional engagement of first and second positioning pins with a plurality of positioning surfaces formed along a cam disk. However, in order to rotate the second hinge member from the upright position, a latching assembly must first be released by rotating an actuator out of engagement with a latching arm to release a locking surface from a locking pin. Only upon this release operation does the second hinge member become rotatable relative to the first hinge member from its upright position.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A positive locking hinge mechanism comprising:

a first hinge member;

a second hinge member coupled to said first hinge member about a pivot;

a latching assembly operably disposed between said first and second hinge members such that said second hinge member may be positively locked in a stowed position relative to said first hinge member and may be moved from said stowed position to a deployed position only upon release of said latching assembly, said latching assembly including:

a locking member coupled to said second hinge member and being rotatable therewith;

a pivotable latching member coupled to said first hinge member and being rotatable between a locking position and a release position, said latching member including a locking surface engaging said locking member in said locking position and being spaced apart from said locking member in said release position;

an actuator coupled to said hinge member for selectively engaging said latching member to maintain said latching member in said locking position and being selectively moveable out of engagement with said latching member for permitting said latching member to move to said release position.

2. The hinge mechanism of claim 1 further comprising a biasing member urging said actuator into engagement with said latching member such that said actuator automatically engages said latching member when said second hinge member is moved to said stowed position.

3. The hinge mechanism of claim 2 further comprising another biasing member urging said latching member toward said release position such that said latching member automatically spaces apart from said locking member when said actuator is moved out of engagement with said latching member thereby permitting said second hinge member to be rotated from said stowed position toward said deployed position.

4. The hinge mechanism of claim 1 further comprising an orientation member coupled to said first hinge member having at least two positioning surfaces cooperating with positioning members coupled to said second hinge member for positioning said second hinge member in preselected orientations relative to said first hinge member.

5. The hinge mechanism of claim 1 further comprising a pull tab coupled to said actuator for enabling a user to move said actuator into and out of engagement with said latching member.

6. A positive locking hinge mechanism having a first hinge member coupled to a second hinge member about a pivot and a latching assembly operably disposed between the first and second hinge members such that the second hinge member may be positively locked in a stowed position and may be moved from the stowed position toward a deployed position only upon release of the latching assembly, said latching assembly comprising:

a locking pin laterally coupled to said second hinge member and being rotatable therewith;

a pivotable latching arm coupled to said first hinge member about a second pivot and being positionable between a locking position for preventing rotation of said second hinge member relative to said first hinge member and a release position for allowing rotation of said second hinge member relative to said first hinge member, said latching arm including a recessed surface for at least partially circumferentially engaging said locking pin when said latching arm is in said locking position and for separating from said locking pin as said latching arm is pivoted toward said release position;

a first biasing member interengaging said first hinge member and said latching arm for urging said latching arm toward said release position;

a rotatable actuator arm coupled to said second hinge member including a first end for selectively engaging said latching arm to maintain said latching arm in said locking position and being selectively moveable out of engagement with said latching member for permitting said latching member to move to said release position; and a second biasing member interengaging said second hinge member and said actuator for urging said actuator into engagement with said latching member.

7. The hinge mechanism of claim 6 further comprising a cam disk coupled to said first hinge member having at least two detente surfaces formed in a periphery thereof for selectively partially circumferentially engaging at least one positioning pin laterally coupled to said second hinge member such that said second hinge member is secured in at least one of said stowed position and said deployed position relative to said first hinge member when said at least one positioning pin engages said at least two detentes.

8. The hinge mechanism of claim 7 wherein said cam disk further comprises a generally C-shaped member having a deployed positioning detente and a stowed positioning detente radially spaced apart along an outer surface of said C-shaped member and a complimentary deployed positioning detente and a complimentary stowed positioning detente radially spaced apart along an inner surface of said C-shaped member.

9. The hinge mechanism of claim 8 wherein said second hinge member further comprises a first positioning pin laterally coupled to said second hinge member and movable between said deployed positioning detente and stowed positioning detente as said second hinge member is rotated relative to said first hinge member, and a second positioning pin laterally coupled to said second hinge member and movable in concert with said first positioning pin between said complimentary deployed positioning detente and complimentary stowed positioning detente.

10. The hinge mechanism of claim 7 wherein said cam disk further comprises a generally C-shaped member including a partially circumferentially extending arcuate guide slot formed therein for cooperating with a guide pin laterally coupled to said first hinge member.

11. A positive locking hinge mechanism for an armrest or seatback having a first hinge member pivotally coupled to a second hinge member about a pivot and a latching assembly operably disposed between the first and second hinge members such that the second hinge member may be positively locked in a stowed position and may be moved from the stowed position to a deployed position essentially orthogonal to the first hinge member only upon release of the latching assembly, said latching assembly comprising:

a locking pin laterally coupled to said second hinge member and being rotatable therewith;

a pivotable, L-shaped latching arm pivotally coupled at a mid-section to said first hinge member about a second pivot so as to be rotatable between a locking position proximate said second hinge member and a release position spaced apart from said second hinge member, said latching arm including a U-shaped locking surface for circumferentially engaging said locking pin when said latching arm is in said locking position to prevent rotation of said second hinge member relative to said first hinge member and for separating from said locking pin when said latching arm is rotated toward said release position to allow rotation of said second hinge member relative to said first hinge member;

a first coil spring interengaging said first hinge member and said latching arm for biasing said latching arm toward said release position;

a rotatable actuator arm having first and second ends and being pivotally coupled to said second hinge member at a midsection about a third pivot so as to be movable between an actuating position where said first end of said actuator arm engages an end of said latching arm and opposes said bias of said first coil spring to maintain said latching arm in said locking position, and a disconnecting position where said first end of said actuator arm rotates out of engagement with said end of said latching member thereby allowing said bias of said first coil spring to rotate said latching member to said release position and enabling said second hinge member to rotate relative to said first hinge member;

a second coil spring interengaging said second hinge member and said actuator for biasing said first end of said actuator into engagement with said end of said latching member;

a generally C-shaped cam disk coupled between said first hinge member and said second hinge member and including a deployed positioning detente, an upright positioning detente, and a stowed positioning detente radially spaced apart along an outer surface of said C-shaped disk and a complimentary deployed positioning detente and a complimentary stowed positioning detente radially spaced apart along an inner surface of said C-shaped disk; and a first positioning pin laterally coupled to said second hinge member and movable between said deployed positioning detente, upright positioning detente, and stowed positioning detente as said second hinge member is rotated between said stowed position and said deployed position, and a second positioning pin laterally coupled to said second hinge member and movable in concert with said first positioning pin between said complimentary deployed positioning detente and complimentary stowed positioning detente such that said second hinge member may be selectively secured in said deployed position, said upright position and said stowed position.

12. The hinge mechanism of claim 11 wherein said cam disk includes a neutral positioning detente between said folded positioning detente and said upright positioning detente.

13. A positive locking hinge mechanism comprising:

a first hinge member pivotally coupled to a second hinge member;

a locking pin laterally coupled to said second hinge member;

a latching arm pivotally coupled to said first hinge member so as to be rotatable between a locking position and a release position, said latching arm including a U-shaped locking surface for engaging said locking pin when said latching arm is in said locking position and disengaging said locking pin as said latching arm is pivoted toward said release position; and an actuator arm pivotally coupled to said second hinge member so as to be rotatable between an actuating position where said actuator arm engages said latching arm to maintain said latching arm in said locking position, and a disconnecting position where said actuator arm disengages said latching member thereby allowing said latching member to rotate to said release position.

14. The hinge mechanism of claim 13 further comprising a generally C-shaped cam disk coupled between said first hinge member and said second hinge member and including a deployed positioning detente, a neutral positioning detente, and a stowed positioning detente radially spaced apart along an outer surface of said C-shaped disk and a complimentary deployed positioning detente and a complimentary stowed positioning detente radially spaced apart along an inner surface of said C-shaped disk.

15. The hinge mechanism of claim 14 further comprising a first positioning pin laterally coupled to said second hinge member and movable between said deployed positioning detente, neutral positioning detente, and stowed positioning detente, and a second positioning pin laterally coupled to said second hinge member and movable in concert with said first positioning pin between said complimentary deployed positioning detente and complimentary stowed positioning detente such that said second hinge member may be selectively secured in said deployed position, neutral position and stowed position.

16. The hinge mechanism of claim 14 wherein said cam disk includes a partially circumferentially extending arcuate guide slot formed therein for cooperating with a guide pin laterally coupled to said first hinge member.

17. The hinge mechanism of claim 13 further comprising a coil spring interengaging said first hinge member and said latching arm for biasing said latching arm toward said release position such that said latching arm automatically disengages from said locking pin when said actuator is moved to said disconnecting position to allow said second hinge member to rotate relative to said first hinge member.

18. The hinge mechanism of claim 13 further comprising a coil spring interengaging said second hinge member and said actuator for biasing said actuator into engagement with said latching member such that said actuator engages said latching arm when said second hinge member is rotated into said stowed position thereby forcing said latching arm into engagement with said locking pin and preventing further rotation of said second hinge member relative to said first hinge member.

* * * * *